US007410516B2

(12) United States Patent
Ivarsson et al.

(10) Patent No.: US 7,410,516 B2
(45) Date of Patent: Aug. 12, 2008

(54) TWIN CYCLONE VACUUM CLEANER

(75) Inventors: Bengt Ivar Anders Ivarsson, Smethwick (GB); Glenn Matusz, Cuyahoga Falls, OH (US); Reuben Proud, Worcester (GB)

(73) Assignee: Royal Appliance Mfg. Co., Glenwillow, OH (US)

( * ) Notice: Subject to any disclaimer, the term of this patent is extended or adjusted under 35 U.S.C. 154(b) by 611 days.

(21) Appl. No.: 11/082,501

(22) Filed: Mar. 17, 2005

(65) Prior Publication Data

US 2006/0207055 A1 Sep. 21, 2006

(51) Int. Cl.
*B01D 45/12* (2006.01)

(52) U.S. Cl. ..... 55/337; 55/349; 55/426; 55/429; 55/433; 55/459.1; 55/DIG. 3; 15/350; 15/353

(58) Field of Classification Search ..... 55/337, 55/346, 349, 426, 429, 459.1, DIG. 3, 433; 15/350, 353
See application file for complete search history.

(56) References Cited

U.S. PATENT DOCUMENTS

| | | | |
|---|---|---|---|
| 3,308,609 | A | 3/1967 | McCulloch |
| 3,320,727 | A | 5/1967 | Farley |
| 4,373,228 | A | 2/1983 | Dyson |
| 4,593,429 | A | 6/1986 | Dyson |
| 5,078,761 | A | 1/1992 | Dyson |
| 5,853,440 | A | 12/1998 | Dyson |
| 5,893,936 | A | 4/1999 | Dyson |
| 6,269,518 | B1 | 8/2001 | Yung |
| 6,334,234 | B1 | 1/2002 | Conrad et al. |
| 6,344,064 | B1 | 2/2002 | Conrad |
| 6,383,266 | B1 | 5/2002 | Conrad et al. |
| 6,406,505 | B1 | 6/2002 | Oh et al. |
| 6,502,278 | B2 | 1/2003 | Oh et al. |
| 6,532,620 | B2 | 3/2003 | Oh |
| 6,558,453 | B2 | 5/2003 | Sepke et al. |

(Continued)

FOREIGN PATENT DOCUMENTS

EP 1 438 918 A1 7/2004

(Continued)

OTHER PUBLICATIONS

Features/Description of a Dyson DC11 model canister vacuum cleaner, Mar. 2005, two pages.

(Continued)

*Primary Examiner*—Robert A Hopkins
(74) *Attorney, Agent, or Firm*—Fay Sharpe LLP

(57) ABSTRACT

An upright vacuum cleaner comprises a housing having a suction airstream inlet and a suction airstream outlet. A dirt container is selectively mounted to the housing for receiving and retaining dirt and dust separated from the suction airstream. The suction airstream inlet and the suction airstream outlet are in fluid communication with, respectively, an inlet and an outlet of the dirt container. The dirt container includes a first cyclonic airflow chamber and a second cyclonic airflow chamber, each cyclonic airflow chamber including a longitudinal axis. The second cyclonic airflow chamber is spaced from the first chamber, wherein the first and second chambers are each approximately vertically oriented and are arranged in a parallel relationship. An air manifold is disposed at a top portion of the dirt container. The air manifold includes an inlet section through which dirty air passes and an outlet section. The inlet section directs a flow of dirty air into two separate inlet conduits leading to a respective one of the first and second airflow chambers. The outlet section collects a flow of cleaned air from both of the chambers and merges the flow of cleaned air into a single outlet conduit. An airstream suction source is mounted to the housing and is in communication with the outlet conduit of the manifold.

22 Claims, 13 Drawing Sheets

U.S. PATENT DOCUMENTS

| | | | | |
|---|---|---|---|---|
| 6,572,668 | B1 | 6/2003 | An et al. | |
| 6,582,489 | B2 | 6/2003 | Conrad | |
| 6,596,044 | B1 | 7/2003 | Bilek et al. | |
| 6,613,129 | B2 | 9/2003 | Gen | |
| 6,616,721 | B2 | 9/2003 | Oh | |
| 6,732,406 | B2 | 5/2004 | Oh | |
| 6,782,585 | B1 | 8/2004 | Conrad et al. | |
| 7,273,506 | B2 * | 9/2007 | Oh et al. | 55/343 |
| 2003/0136094 | A1 | 7/2003 | Illingworth et al. | |
| 2004/0040270 | A1 | 3/2004 | Inoue et al. | |
| 2004/0098828 | A1 | 5/2004 | Oh | |
| 2004/0107530 | A1 | 6/2004 | Lee | |
| 2004/0237248 | A1 | 12/2004 | Oh et al. | |
| 2005/0229554 | A1 | 10/2005 | Oh et al. | |

FOREIGN PATENT DOCUMENTS

| | | |
|---|---|---|
| EP | 1 488 729 A2 | 12/2004 |
| JP | 38-5341 | 4/1963 |
| JP | 5-123609 | 5/1993 |
| SE | 9601771 | 1/1997 |
| WO | WO 00/49933 | 8/2000 |
| WO | WO 00/74548 A1 | 12/2000 |

OTHER PUBLICATIONS

International Search Report dated Oct. 6, 2006.

Service Manual for Panasonic Vacuum Cleaner Models MC-E4001, MC-E4003, 1 page, Copyright 2003 Matsushita Electric Espana, S.A..

* cited by examiner

TWIN CYCLONE VACUUM CLEANER

BACKGROUND OF THE INVENTION

The present invention relates to vacuum cleaners. More particularly, the present invention relates to upright vacuum cleaners used for suctioning dirt and debris from carpets and floors.

Upright vacuum cleaners are well known in the art. The two major types of traditional vacuum cleaners are a soft bag vacuum cleaner and a hard shell vacuum cleaner. In the hard shell vacuum cleaner, a vacuum source generates the suction required to pull dirt from the carpet or floor being vacuumed through a suction opening and into a filter bag or a dust cup housed within the hard shell upper portion of the vacuum cleaner. After multiple uses of the vacuum cleaner, the filter bag must be replaced or the dust cup emptied.

To avoid the need for vacuum filter bags, and the associated expense and inconvenience of replacing the filter bag, another type of upright vacuum cleaner utilizes cyclonic air flow and one or more filters, rather than a replaceable filter bag, to separate the dirt and other particulates from the suction air stream. Such filters need infrequent replacement.

While some prior art cyclonic air flow vacuum cleaner designs and constructions are satisfactory, it is desirable to develop continued improvements and alternative designs for such vacuum cleaners. For example, it would be desirable to simplify assembly and improve filtering and dirt removal.

Accordingly, the present invention provides a new and improved upright vacuum cleaner having a twin cyclonic airflow design which overcomes difficulties with the prior art while providing better and more advantageous overall results.

BRIEF DESCRIPTION OF THE INVENTION

In one embodiment of the present invention, a twin cyclone vacuum cleaner is provided.

More particularly, in accordance with this aspect of the present invention, a vacuum cleaner comprises a housing having a suction airstream inlet and a suction airstream outlet. A dirt container is selectively mounted to the housing for receiving and retaining dirt and dust separated from the suction airstream. The suction airstream inlet and the suction airstream outlet are in fluid communication with, respectively, an inlet and an outlet of the dirt container. The dirt container includes a first cyclonic airflow chamber and a second cyclonic airflow chamber, each cyclonic airflow chamber including a longitudinal axis. The second cyclonic airflow chamber is spaced from the first chamber, wherein the first and second chambers are each approximately vertically oriented and are arranged in a parallel relationship. An air manifold is disposed at a top portion of the dirt container. The air manifold includes an inlet section through which dirty air passes and an outlet section. The inlet section directs a flow of dirty air into two separate inlet conduits leading to a respective one of the first and second airflow chambers. The outlet section collects a flow of cleaned air from both of the chambers and merges the flow of cleaned air into a single outlet conduit. An airstream suction source is mounted to the housing and is in communication with the outlet conduit of the manifold.

In accordance with another aspect of the present invention, a vacuum cleaner includes a housing, a nozzle base having a main suction opening, an airstream suction source, and a dirt cup. The housing is pivotally mounted on the nozzle base. The airstream suction source is mounted to one of the housing and the nozzle base for selectively establishing and maintaining a suction airstream from the nozzle main suction opening to an exhaust outlet of the suction source. The dirt cup is selectively mounted to the housing. The dirt cup comprises a first centrifugal chamber having a first longitudinal axis, a second centrifugal chamber having a second longitudinal axis oriented parallel to the first longitudinal axis, and an air manifold. The first centrifugal chamber includes a first cyclone assembly. The second centrifugal chamber includes a second cyclone assembly. The first and second cyclone assemblies act simultaneously to remove at least some contaminants from the airstream. The air manifold includes a dirty air inlet in fluid communication with the main suction opening, and a pair of dirty air outlets communicating with a respective one of the first and second centrifugal chambers. A pair of cleaned air inlets communicates with a respective one of the first and second centrifugal chambers. A cleaned air outlet is in fluid communication with an inlet of the airstream suction source.

In accordance with yet another aspect of the present invention, a dirt container for a vacuum cleaner comprises a dirt cup housing a first cyclonic flow chamber and a second cyclonic flow chamber. The second chamber is positioned adjacent to and parallel to the first chamber, wherein the first and second chambers are oriented generally vertically. A first perforated tube and a first separator cone extends in the first chamber. A second perforated tube and a second separator cone extends in the second chamber. Each perforated tube includes a plurality of small holes disposed in a side wall of the tube. Each perforated tube further includes an outwardly flared end wall for retarding an upward flow of dust that has fallen below the end wall. An air manifold directs dirty air to each of the first and second cyclonic flow chambers and directs a flow of cleaned air from each of the first and second cyclonic flow chambers to a suction source of the vacuum cleaner.

Still other aspects of the invention will become apparent from a reading and understanding of the detailed description of the several embodiments hereinbelow.

BRIEF DESCRIPTION OF THE DRAWINGS

The present invention may take physical form in certain parts and arrangements of parts, several embodiments of which will be described in detail in this specification and illustrated in the accompanying drawings which form a part of the invention.

DETAILED DESCRIPTION OF THE PREFERRED EMBODIMENTS

Figure 1:
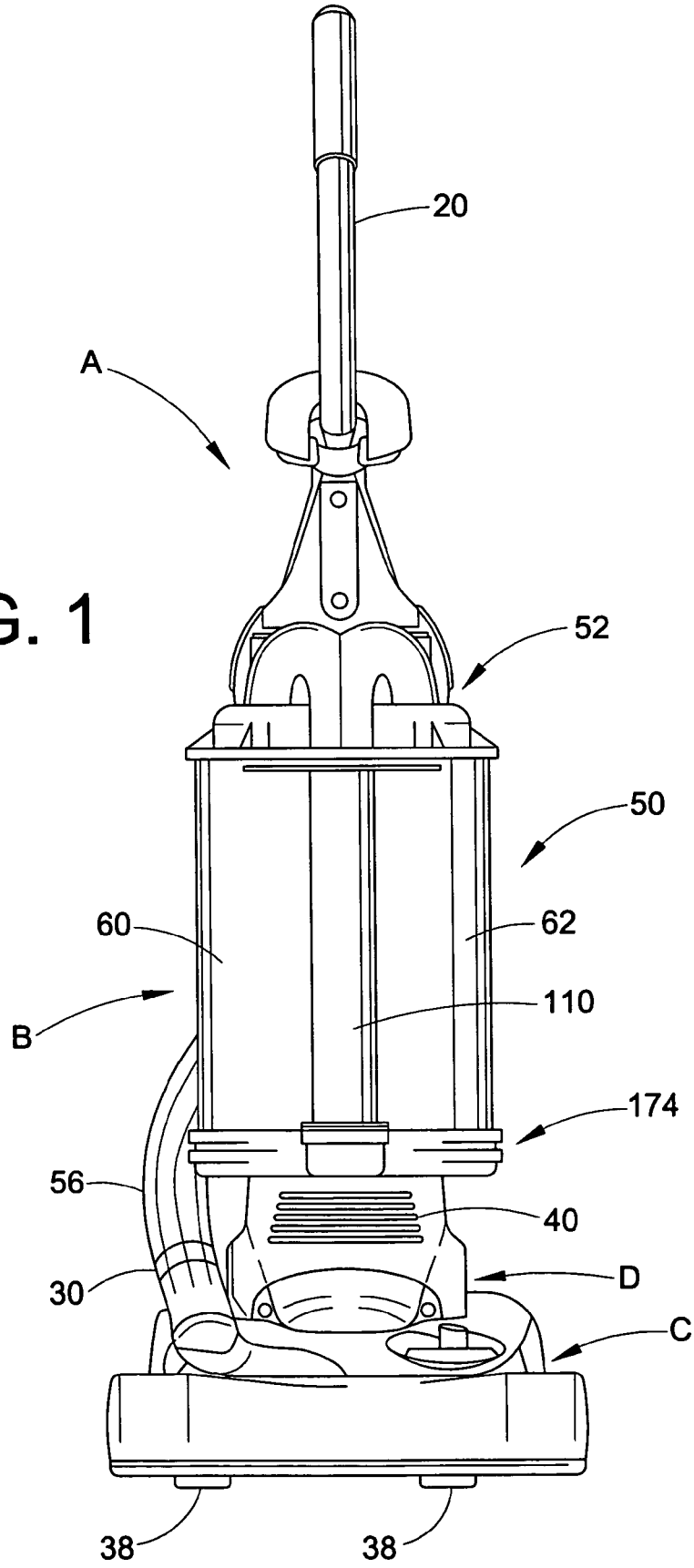
FIG. 1 is a front elevational view illustrating a cyclonic air flow vacuum cleaner including a dirt cup in accordance with a first embodiment of the present invention.

Referring now to the drawings, wherein the drawings illustrate the preferred embodiments of the present invention only and are not intended to limit same, FIG. 1 shows an upright vacuum cleaner A including an upright housing section B and a nozzle base section C. The sections B and C are pivotally or hingedly connected through the use of trunnions or another suitable hinge assembly D so that the upright housing section B pivots between a generally vertical storage position (as shown) and an inclined use position. Both the upright and nozzle sections B and C can be made from conventional materials, such as molded plastics and the like. The upright section B includes a handle 20 extending upward therefrom, by which an operator of the vacuum cleaner A is able to grasp and maneuver the vacuum cleaner.

Figure 2:
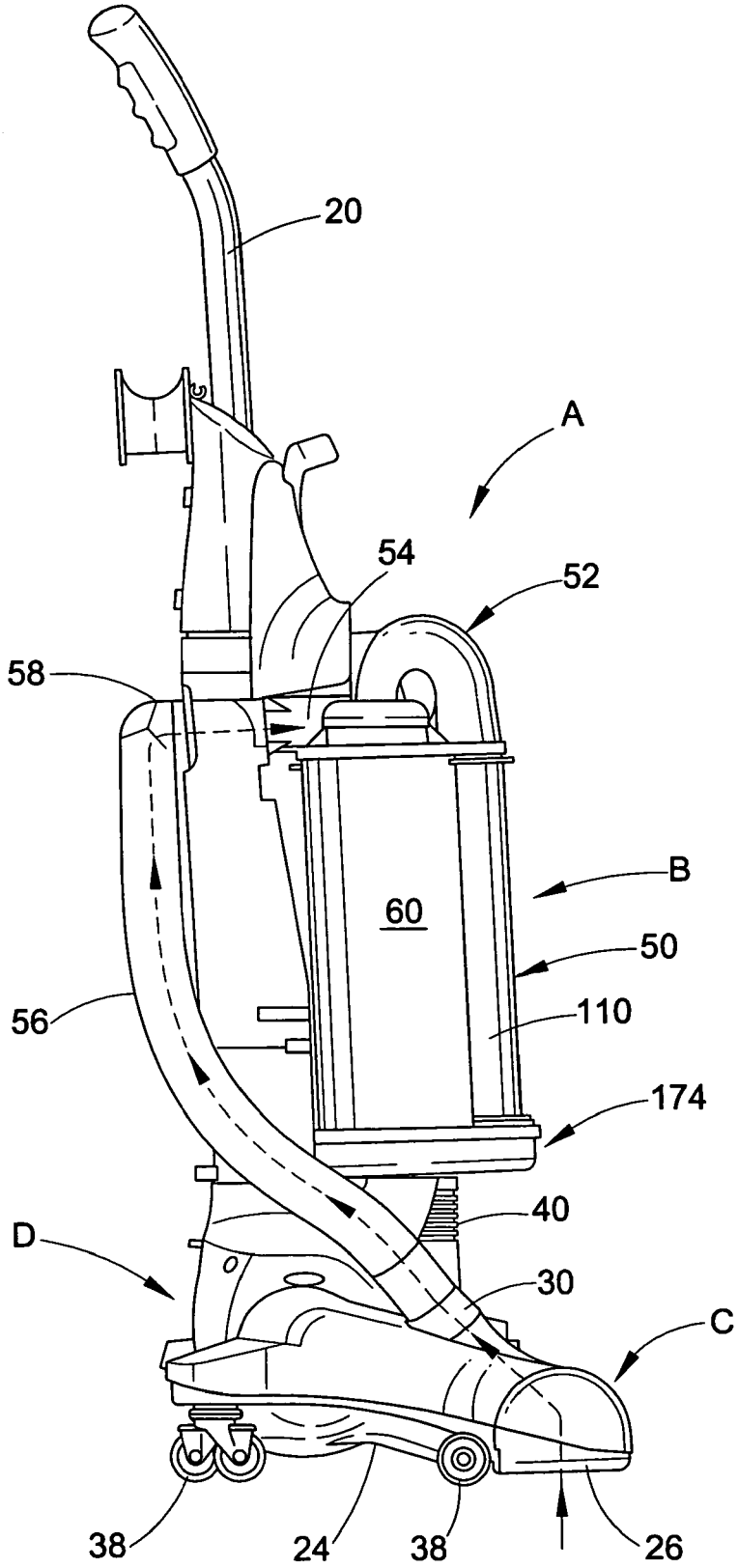
FIG. 2 is a left side elevational view of the cyclonic air flow vacuum cleaner of FIG. 1.
Figure 3:
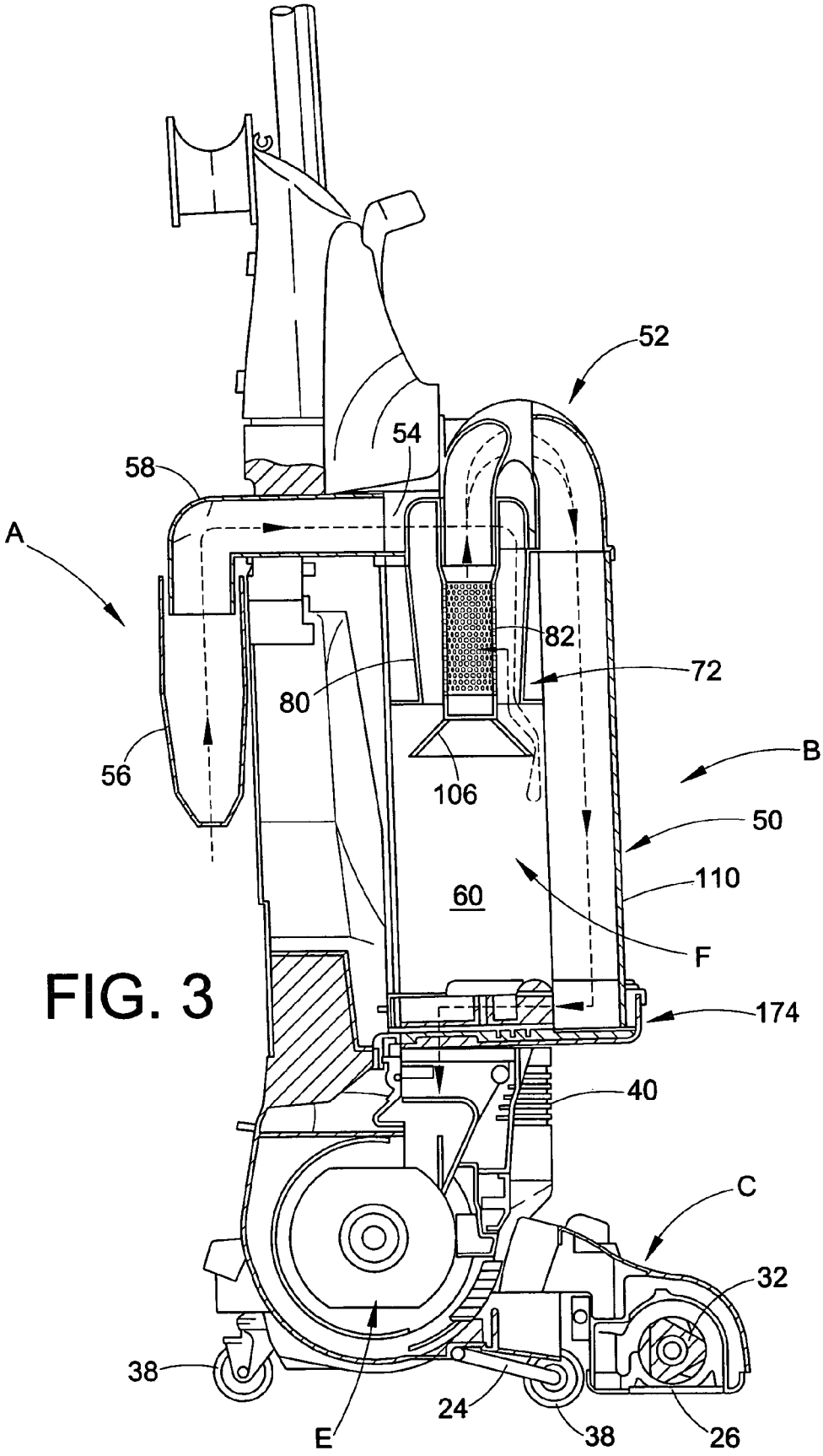
FIG. 3 is an enlarged left side elevational view in cross section, and partially broken away, of the cyclonic air flow vacuum cleaner of FIG. 1.

During vacuuming operations, the nozzle base C travels across a floor, carpet, or other subjacent surface being cleaned. With reference now to FIGS. 2 and 3, an underside 24 of the nozzle base includes a main suction opening 26 formed therein, which can extend substantially across the width of the nozzle at the front end thereof. As is known, the main suction opening 26 is in fluid communication with the vacuum upright body section B through a passage and a connector hose assembly, such as at 30. A rotating brush assembly 32 is positioned in the region of the nozzle main suction opening 26 for contacting and scrubbing the surface being vacuumed to loosen embedded dirt and dust. A plurality of wheels 38 supports the nozzle on the surface being cleaned and facilitate its movement thereacross.

The upright vacuum cleaner A includes a vacuum or suction source for generating the required suction airflow for cleaning operations. A suitable suction source, such as an electric motor and fan assembly E, generates a suction force in a suction inlet and an exhaust force in an exhaust outlet. The motor assembly airflow exhaust outlet is in fluid communication with an exhaust grill 40. If desired, a final filter assembly can be provided for filtering the exhaust airstream of any contaminants which may have been picked up in the motor assembly immediately prior to its discharge into the atmosphere. The motor assembly suction inlet, on the other hand, is in fluid communication with a dust and dirt separating region F (FIG. 3) of the vacuum cleaner A to generate a suction force therein.

The dust and dirt separating region F housed in the upright section B includes a dirt cup or container 50 which is releasably connected to the upper housing B of the vacuum cleaner. Cyclonic action in the dust and dirt separating region F removes a substantial portion of the entrained dust and dirt from the suction airstream and causes the dust and dirt to be deposited in the dirt container 50. The suction airstream enters an air manifold 52 of the dirt container through a suction airstream inlet section 54 which is formed in the air manifold. The suction airstream inlet 54 is in fluid communication with a suction airstream hose 56 through a fitting 58 as illustrated in FIGS. 2 and 3. The dirt container 50 can be mounted to the vacuum cleaner upright section B via conventional means.

Figure 4:
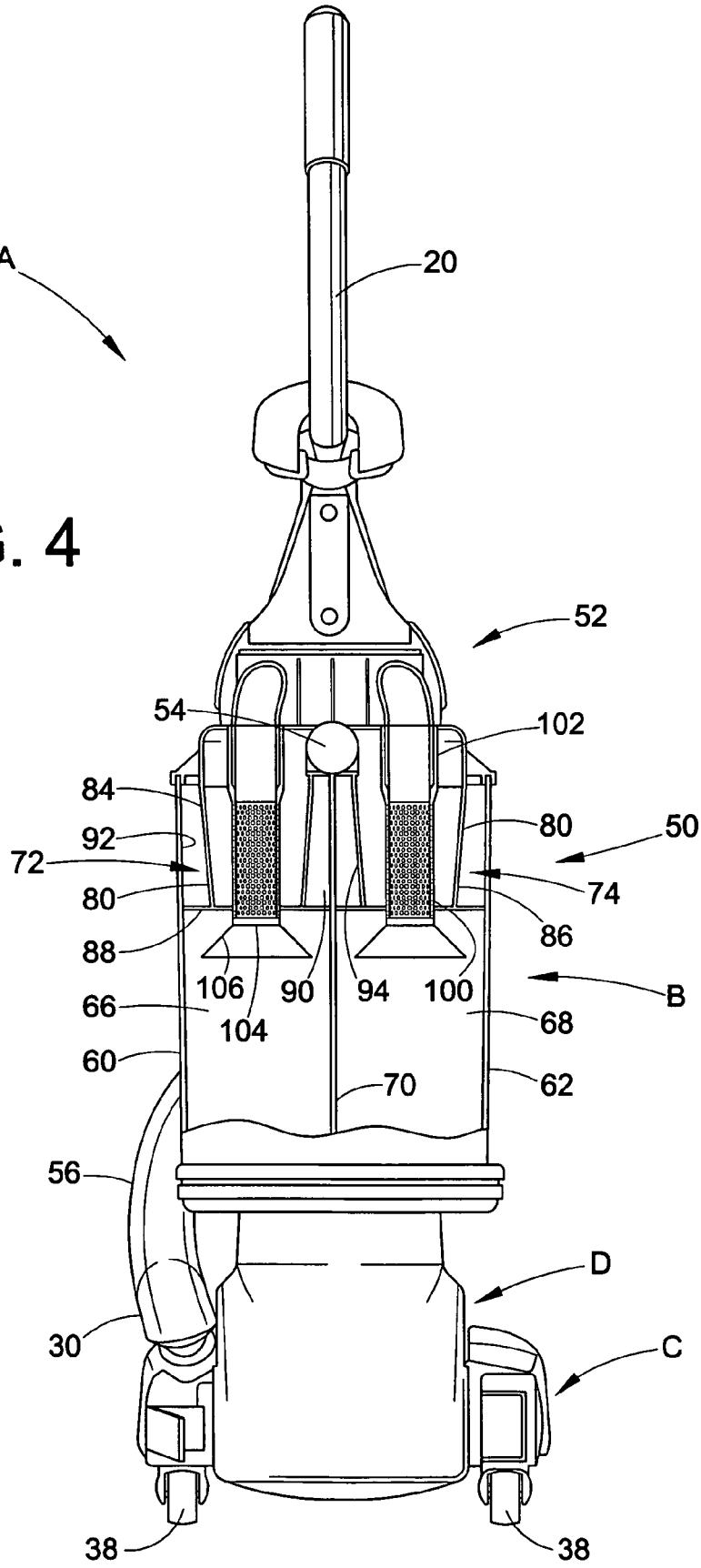
FIG. 4 is a rear elevational view in cross section, and partially broken away, of the cyclonic air flow vacuum cleaner including of FIG. 1.

As shown in FIG. 4, the dirt container 50 includes first and second generally cylindrical sections 60 and 62. Each cylindrical sections includes a longitudinal axis, the longitudinal axis of the first cylindrical section is spaced from the longitudinal axis of the second cylindrical section. The first and second cylindrical sections define a first cyclonic airflow chamber 66 and a second cyclonic airflow chamber 68, respectively. The first and second airflow chambers are each approximately vertically oriented and are arranged in a parallel relationship. The cylindrical sections 60, 62 have a common outer wall and are separated from each other by a dividing wall 70.

The first and second cyclonic airflow chambers include respective first and second cyclone assemblies 72 and 74. The first and second cyclone assemblies act simultaneously to remove coarse dust from the airstream. Each cyclone assembly includes a separator cone 80 and a perforated tube 82 disposed within the separator cone. The separator cones have a larger diameter end 84 located adjacent a top portion of the dirt container 50 and a smaller diameter end 86 spaced from the top portion. A flange 88 extends radially from the smaller diameter end 84. As best illustrated in FIG. 4, the flange is dimensioned to effectively seal off a space 90, which is defined by an inner surface 92 of each cylindrical section 60, 62, the dividing wall 70 and an outer periphery 94 of the separator cone 80, from the dirt entrained airstream entering into the first and second cyclonic airflow chambers 66, 68.

Each perforated tube 82 extends longitudinally in its respective cyclonic airflow chamber 66 and 68. In the present embodiment, the tubes have longitudinal axes coincident with the longitudinal axes of the first and second cylindrical sections 60, 62; although, it should be appreciated that the respective axes can be spaced from each other. Each perforated tube 82 includes a plurality of small holes 100 disposed in a side wall of the tube for removing threads and fibers from the airstream. The diameter of the holes 100 and the number of those holes within the perforated tube 82 directly affect the filtration process occurring within each cyclonic airflow chambers 66, 68. Also, additional holes result in a larger total opening area and thus the airflow rate through each hole is reduced. Thus, there is a smaller pressure drop and lighter dust and dirt particles will not be as likely to block the holes.

Each perforated tube further includes an upper end 102 in fluid communication with the inlet section 54 of the air manifold 52 and a closed lower end 104. The closed lower end of each tube 82 includes an outwardly flared portion 106 for retarding an upward flow of dust that has fallen below the lower end 104.

With continued reference to FIGS. 3 and 4, the air manifold 52 is disposed at a top portion of the dirt container 50. The air manifold directs dirty air to each of the first and second cyclonic flow chambers 66, 68 and directs a flow of cleaned air from each of the first and second cyclonic flow chambers to the electric motor and fan assembly E of the vacuum cleaner A. The features of the air manifold and the securing of the air manifold to the dirt container 50 will be discussed in greater detail below with reference to a second embodiment of the vacuum cleaner A.

The air manifold 52 collects a flow of cleaned air from both of the airflow chambers and merges the flow of cleaned air into a single cleaned air outlet passage or conduit 110 which is in fluid communication with an inlet (not shown) of the electric motor and fan assembly E. With continued reference to FIG. 3, the outlet passage 110 has a longitudinal axis which is oriented approximately parallel to the longitudinal axes of the first and second cyclonic chambers 66, 68. The features of the outlet passage and the securing of the outlet passage to the air manifold 52 will also be discussed in greater detail below with reference to a second embodiment of the vacuum cleaner A.

Figure 5:
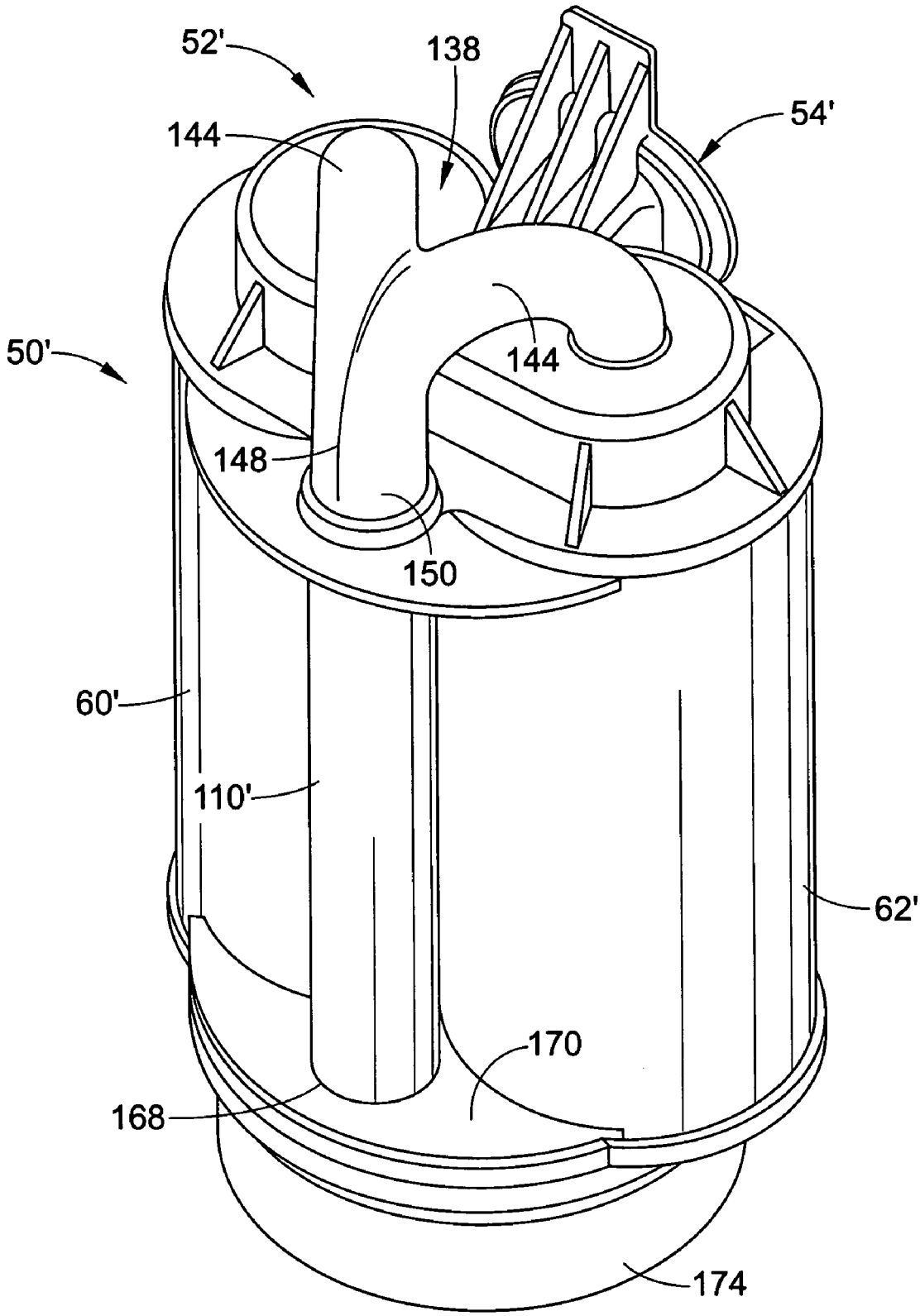
FIG. 5 is an enlarged front perspective view of an assembled dirt cup for the cyclonic air flow vacuum cleaner of FIG. 1 in accordance with a second embodiment of the present invention.
Figure 6:
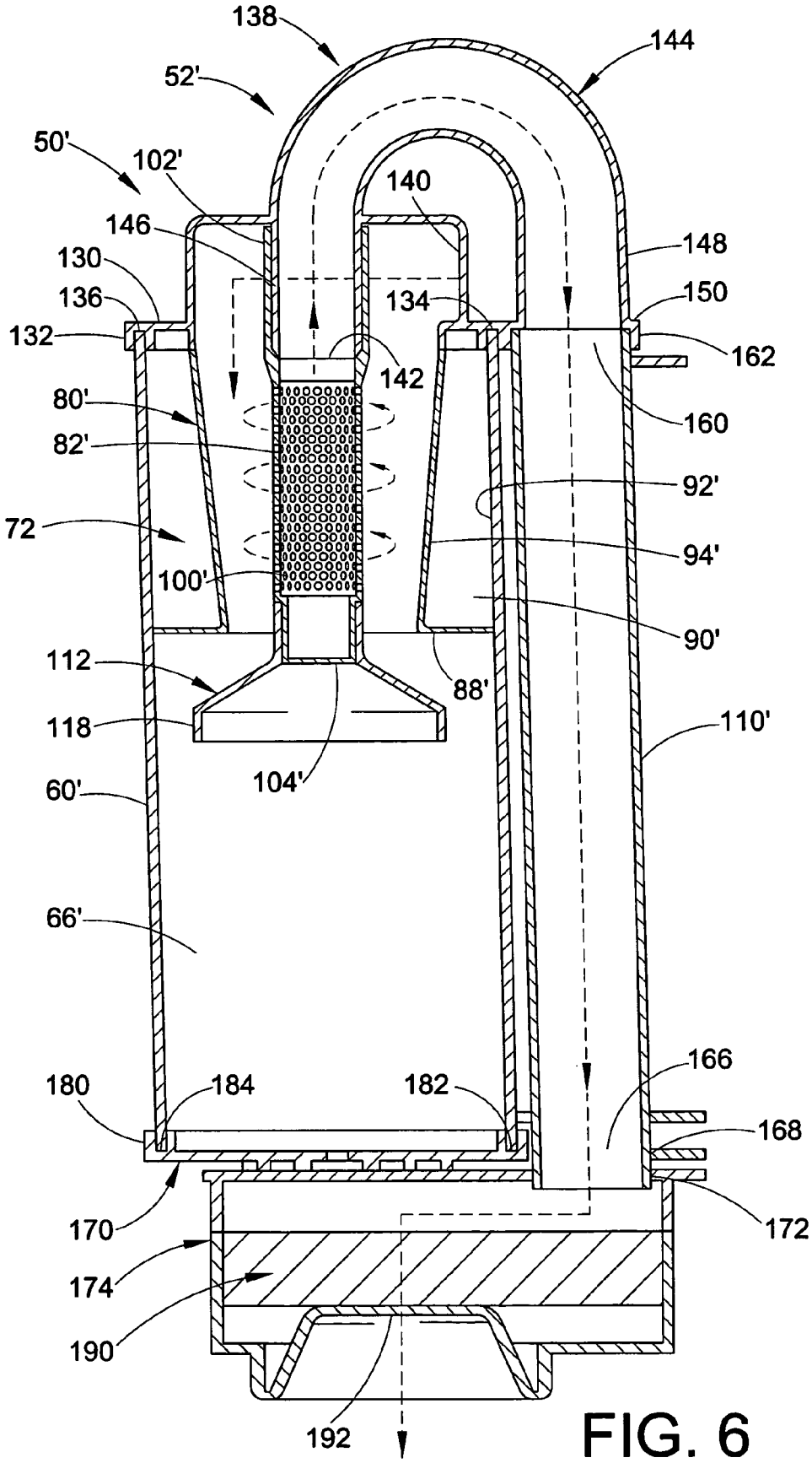
FIG. 6 is a side cross-sectional view of the dirt cup of FIG. 5 and a portion of a base on which it rests.
Figure 7:
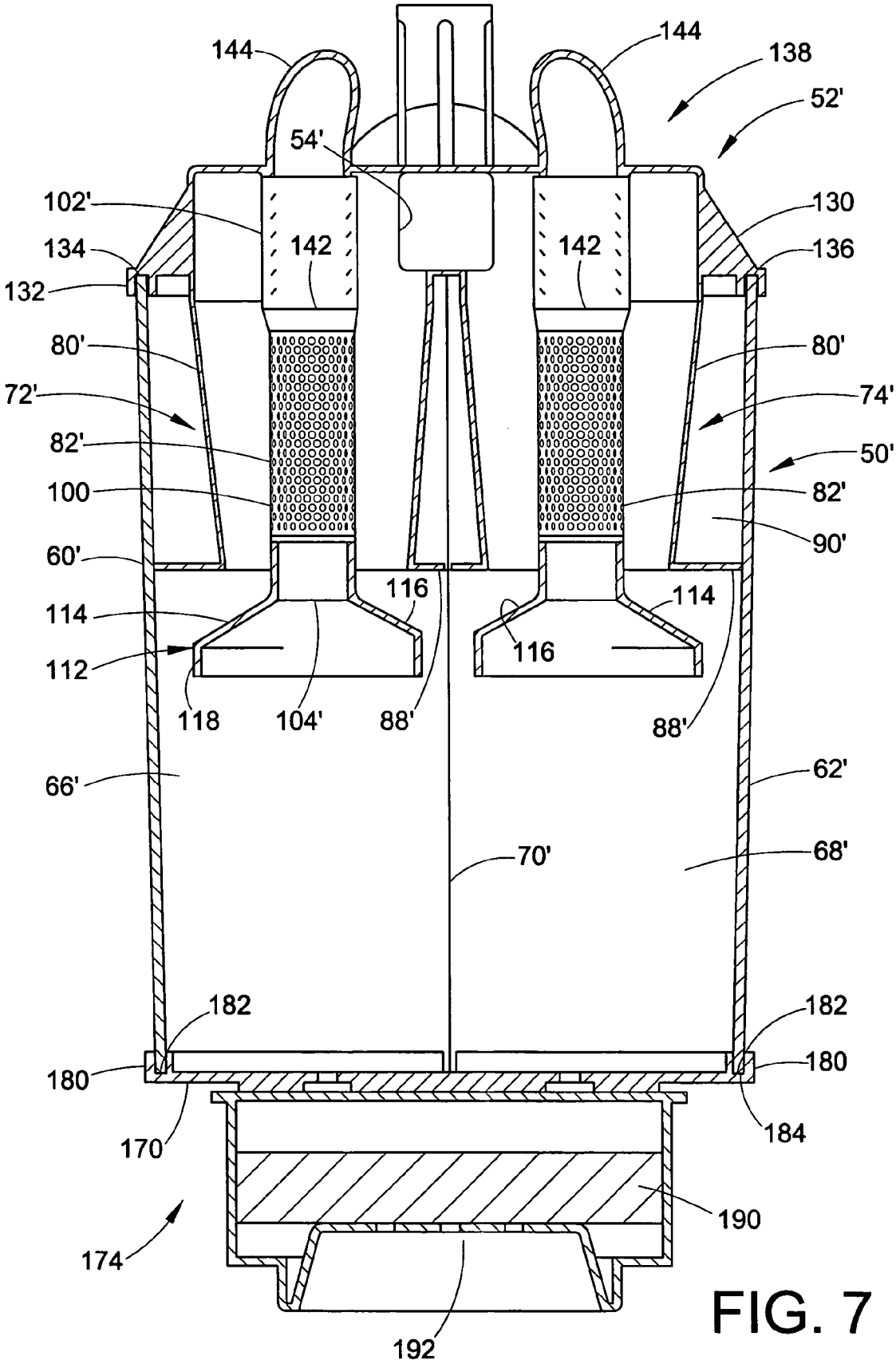
FIG. 7 is a front cross-sectional view of the dirt cup of FIG. 5.

Similar to the aforementioned embodiment, a second embodiment is shown in FIGS. 5-7. Since most of the structure and function is substantially identical, reference numerals with a single primed suffix (') refer to like components (e.g., dirt container is referred to by reference numeral 50'), and new numerals identify new components in the additional embodiment.

With reference to FIGS. 6 and 7, the dirt container 50' includes first and second generally cylindrical sections 60' and 62'. The first and second cylindrical sections include a first cyclonic airflow chamber 66' and a second cyclonic airflow chamber 68', respectively, each cyclonic airflow chamber including a longitudinal axis. The cylindrical sections 60', 62' have a common outer wall and are separated from each other by a dividing wall 70'.

The first and second cyclonic airflow chambers include respective first and second cyclone assemblies 72' and 74'. Each cyclone assembly includes a separator cone 80' and a perforated tube 82' disposed within the separator cone. The separator cones have a larger diameter end 84' located adjacent a top portion of the dirt container 50' and a smaller diameter end 86' spaced from the top portion. A flange 88' extends radially from the smaller diameter end 84'.

Each perforated tube 82' extends longitudinally in each cyclonic airflow chambers 66', 68' and includes a plurality of small holes 100' disposed in a side wall of the tube. Each perforated tube further includes an upper end 102' in fluid communication with the inlet section 54' of the air manifold 52' and a closed lower end 104'. As shown in FIGS. 6 and 7, the closed lower end of each tube 82 includes an outwardly flared section 112 which also retards an upward flow of dust that has fallen below the lower end 104'. The flared section includes a first portion 114 and a second portion 116, the first portion being larger than the second portion. A flange 118 extends longitudinally from the flared section which also blocks rising dust from reentering the separator cone, thereby further improving the filtering of the dust entrained airstream.

With continued reference to FIGS. 6 and 7, to secure the air manifold to the dirt container 50, a lower portion 130 of the air manifold includes downwardly extending flanges 132 which define a recess 134. The recess is dimensioned to receive at least an upper peripheral end 136 of each cylindrical section 60' and 62', thereby creating a seal between the air manifold and the dirt container.

The air manifold includes the inlet section 54' through which dirty air passes and an outlet section 138. The inlet section, which is in fluid communication with the nozzle main suction opening 26, directs a flow of the dirty airstream into two separate dirty air outlets 140 leading to a respective one of the first and second airflow chambers 66', 68'. As is evident from FIGS. 6 and 7, an in-line flow path is thus provided from the air manifold inlet section 54' through the motor and fan assembly. More specifically, dirty air flows into the inlet section 54', into the two separate dirty air outlets 140 and thus into the first and second airflow chambers 66', 68' defined within the dirt container 50'. As illustrated by the arrows in FIGS. 6 and 7, the airflow into the airflow chambers 66', 68' is tangential. This causes a vortex-type, cyclonic or swirling flow as is illustrated by the arrows. Such vortex flow is directed downwardly in the airflow chamber since the top end thereof is blocked by the flange 88' of the separator cone 80'.

The outlet section 138 collects a flow of cleaned air from both of the airflow chambers and merges the flow of cleaned air into the single cleaned air outlet passage 110' which is in fluid communication with the inlet of the electric motor and fan assembly E. After being filtered, the air flows into and through the suction motor and fan assembly as is illustrated by the arrows. After being exhausted from the motor and fan assembly E, the air flows through the grill 40.

The outlet section includes a pair of cleaned air inlets 142 communicating with a respective one of the first and second centrifugal chambers 66', 68'. Each inlet is in fluid communication with a pair of cleaned air conduits 144. As shown in FIG. 6, a first end 146 of each cleaned air conduit 144 is secured to the upper end 102' of each perforated tube 82'. In this embodiment, the upper end 102' has an inner diameter greater than an outer diameter of the cleaned air conduit first end 146 such that the first end 146 is frictionally received in the upper end 102'. However, it should be appreciated that the cleaned air conduit first end 146 can have an outer diameter larger than an inner diameter of the upper end 102' such that the upper end 102' is frictionally received in the first end 146.

With reference to FIGS. 5 and 7, each cleaned air conduit 144 has a second end 148 which merges into a single outlet end 150 that is in fluid communication with an inlet 144 of the outlet passage 110'.

The outlet passage 110' has a longitudinal axis which is oriented approximately parallel to the longitudinal axes of the first and second cyclonic chambers 66', 68'. With reference again to FIG. 6, the inlet end 160 of the outlet passage 110' is secured to the lower portion 130 of the air manifold 52' and the single outlet end 150 of the cleaned air outlet conduits 144 by one of the flanges 132 and a flange 162 extending from the outlet end 150. An outlet end 166 of the outlet passage 110' extends through an opening 168 located in a bottom wall 170 of the dirt container 50' and a corresponding opening 172 located in a filter plenum 174. Similar to the flanges 132 of the air manifold, the bottom includes flanges 180 which also define a recess 182 dimensioned to receive at least a lower peripheral end 184 of each cylindrical sections 60' and 62', thereby creating a seal between the bottom and the dirt container.

As shown in FIGS. 6 and 7, the filter plenum 174, which can be located beneath the dirt container 50', houses a filter 190 which is in fluid communication with the outlet end 166 of the outlet passage 110'. The filter is disposed downstream from the first and second cyclonic chambers 66', 68' for filtering fine dirt from the airstream. The plenum can be suitably secured to one of the upright housing section B and a nozzle base section C by conventional means. An outlet 192 of the filter plenum 174 is in fluid communication with the inlet of the electric motor and fan assembly E.

Figure 8:
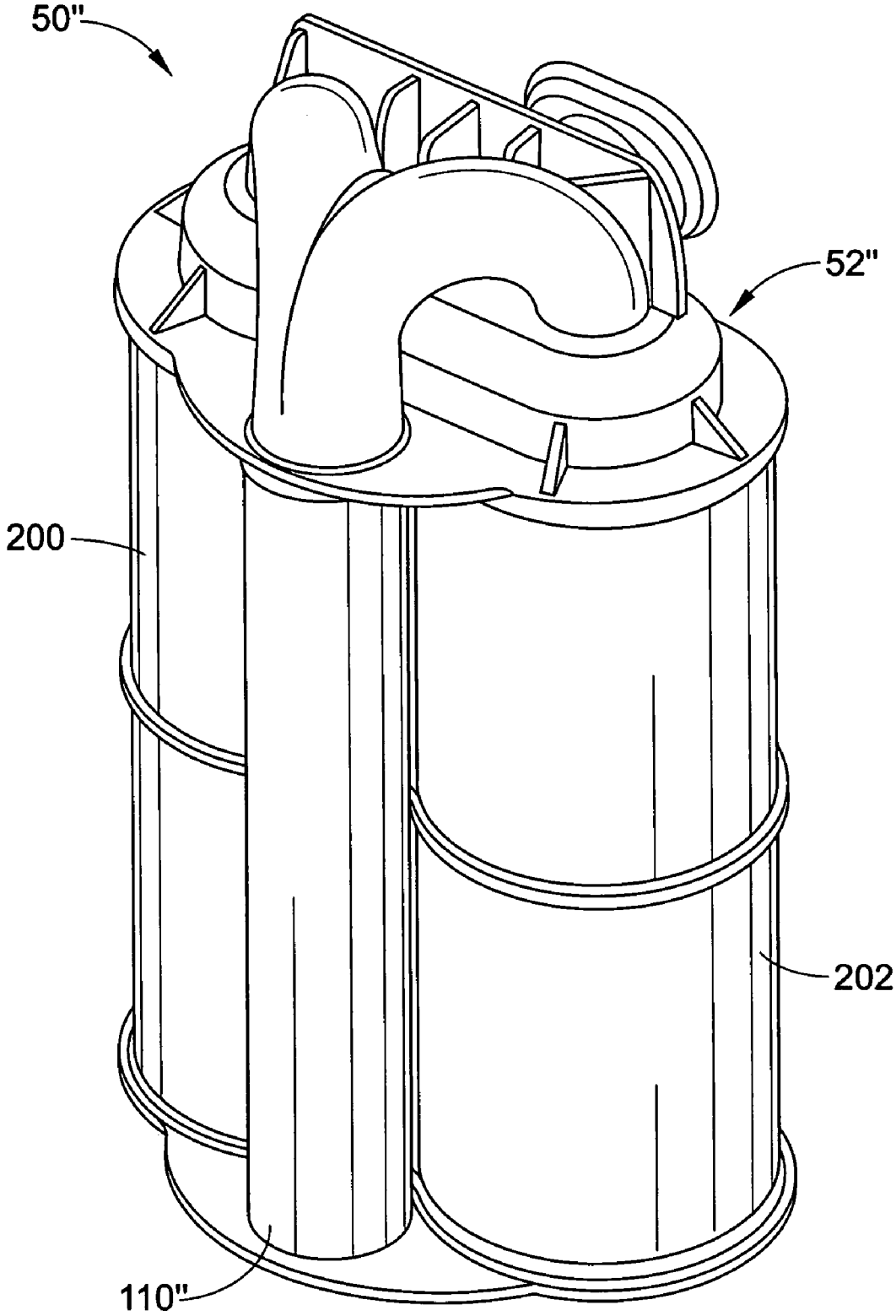
FIG. 8 is an assembled front perspective view of a dirt cup for the cyclonic air flow vacuum cleaner of FIG. 1 in accordance with a third embodiment of the present invention.
Figure 9:
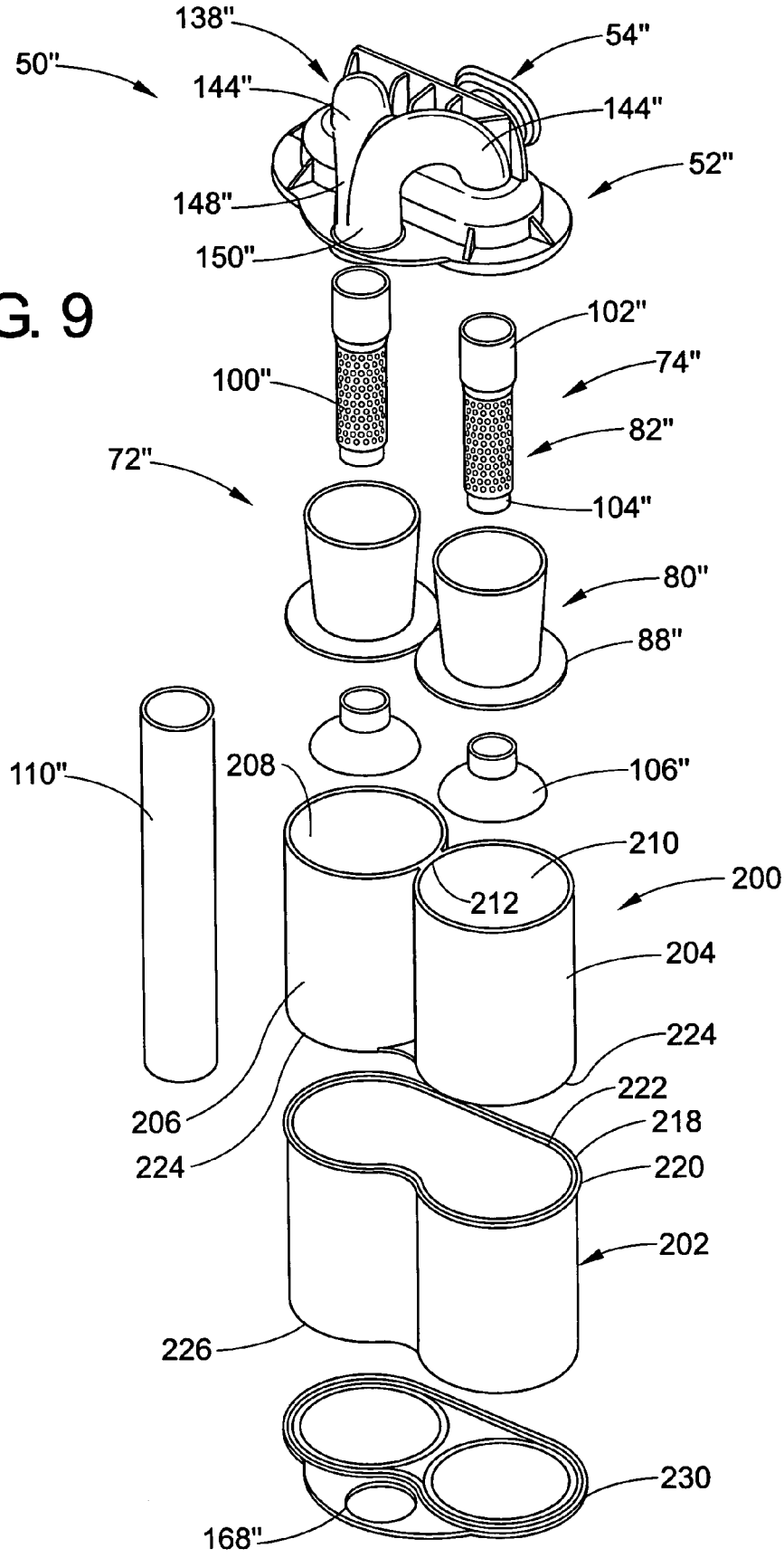
FIG. 9 is an exploded front perspective view of the dirt cup of FIG. 8.

Similar to the aforementioned embodiment, a third embodiment is shown in FIGS. 8 and 9. Since most of the structure and function is substantially identical, reference numerals with a double primed suffix (") refer to like components (e.g., dirt container is referred to by reference numeral 50"), and new numerals identify new components in the additional embodiment.

With reference to FIGS. 8 and 9, the dirt container 50" includes an upper portion 200 mounted to lower portion 202. The upper portion includes first and second generally cylindrical sections 204 and 206. The first and second cylindrical sections include a first cyclonic airflow chamber 208 and a second cyclonic airflow chamber 210, respectively. Each cyclonic airflow chamber includes a longitudinal axis. The longitudinal axis of the first cyclonic airflow chamber is spaced from the longitudinal axis of the second cyclonic airflow chamber and is oriented parallel thereto. The cylindrical sections 204, 206 are connected to each other by a common wall section 212. The first and second airflow chambers are each approximately vertically oriented and are arranged in a parallel relationship. The first and second cyclonic airflow chambers include the respective first and second cyclone assemblies 72" and 74".

Similar to the second embodiment, the air manifold 52" is secured to a top portion of the upper portion 200 of the dirt container 50". The air manifold directs dirty air to each of the first and second cyclonic flow chambers 208, 210. To secure the upper portion 200 to the lower portion 202, a top end 218 of the lower portion includes a lip 220 having a first section extending outwardly from the top end and a second section extending generally normal to the first section. The lip defines a shelf 222 which is dimensioned to receive a lower end 224 of the upper portion 200. A bottom end 226 of the lower portion 202 is secured to a bottom wall 230 of the dirt container 50" in a manner similar to the above described second embodiment, particularly the securing of the cylindrical sections 60', 62' to the bottom 170 of the dirt container 50'.

Similar to the aforementioned embodiments, a fourth embodiment is shown in FIGS. 10-14. Since most of the structure and function is substantially identical, reference numerals with a triple primed suffix (''') refer to like components (e.g., dirt container is referred to by reference numeral 50'''), and new numerals identify new components in the additional embodiment.

With reference to FIGS. 10-14, the dirt container 50''' includes an air manifold 300 and first and second generally cylindrical sections 302 and 304. The first and second cylindrical sections include a first cyclonic airflow chamber 310 and a second cyclonic airflow chamber 312, respectively. The first and second airflow chambers are each approximately vertically oriented and are arranged in a parallel relationship. The cylindrical sections are connected to each other by a common wall section 314. First and second rim sections 316, 318 extend between a top portion 320 of the cylindrical sections.

Figure 11:
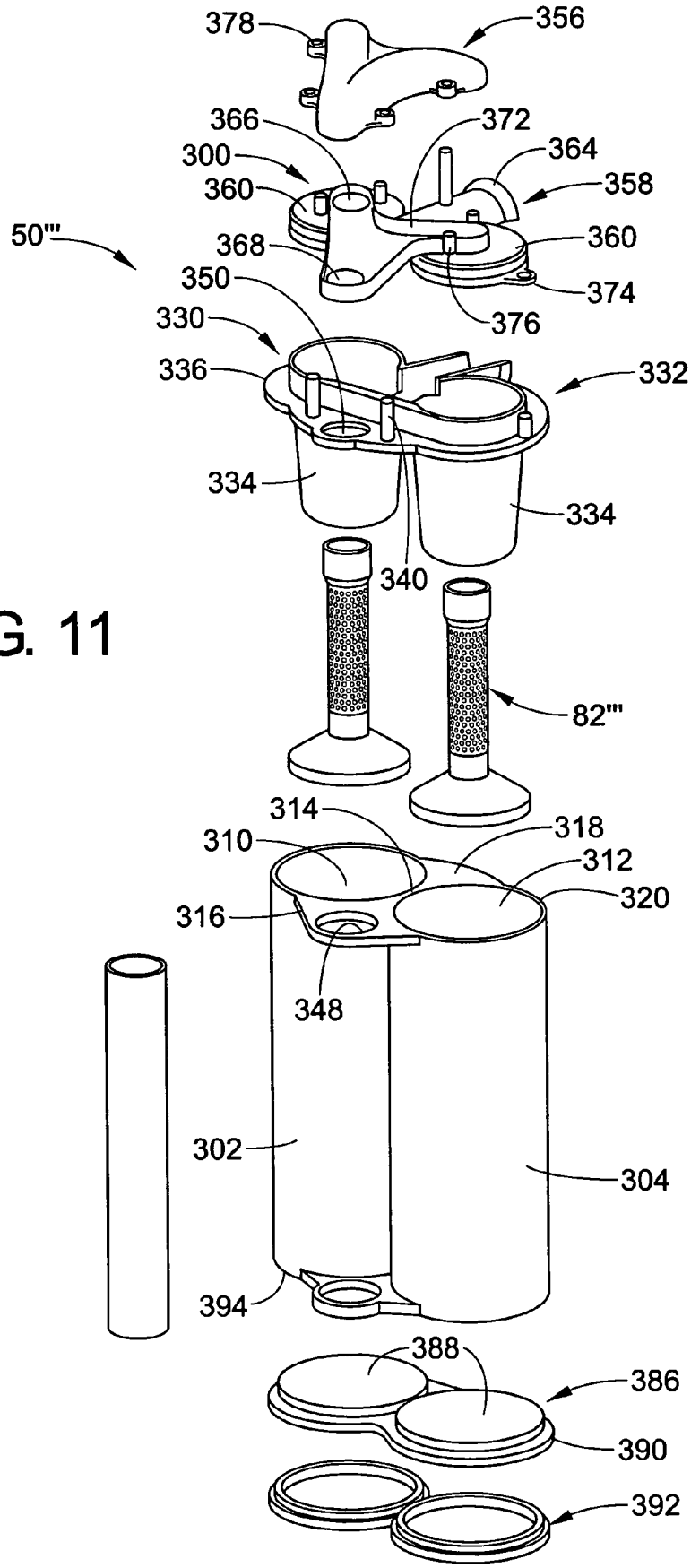
FIG. 11 is an exploded front perspective view of the dirt cup of FIG. 10.

As shown in FIG. 11, the first and second cyclonic airflow chambers include respective first and second cyclone assemblies 330 and 332. These cyclone assemblies act simultaneously to remove coarse dust from the airstream. Each cyclone assembly includes a separator cone 334 and a perforated tube 82''' disposed within the separator cone. A flange 336 extends continuously around a top portion of the separator cones 334. As best illustrated in FIG. 12, the flange is dimensioned to effectively seal the top portion 320 of the cylindrical sections 302 and 304.

Figure 12:
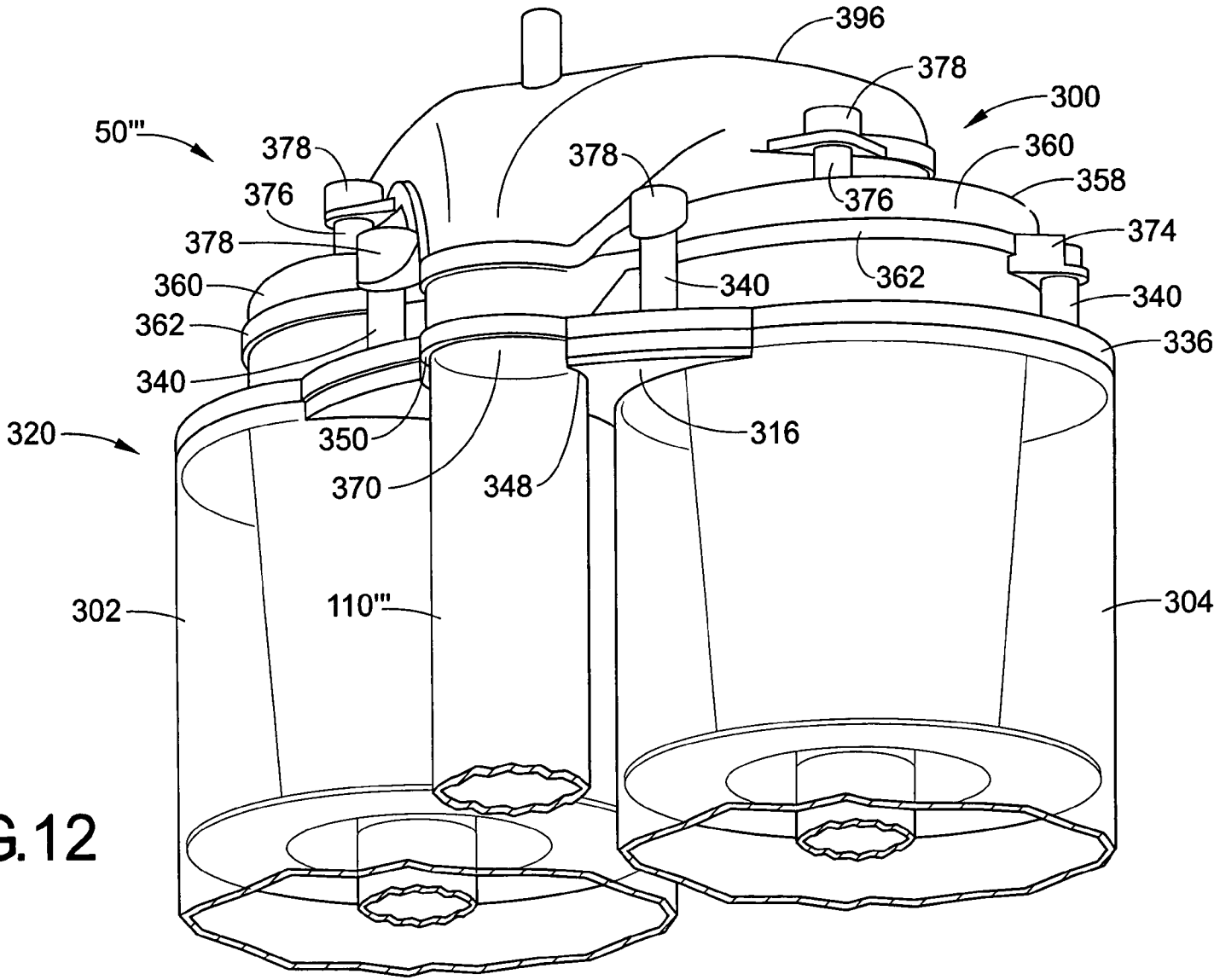
FIG. 12 is an enlarged front perspective view of an upper portion of the dirt cup of FIG. 10.

With continued reference to FIG. 12, extending from the flange 336 are a plurality of first projections 340, a first portion of the first projection extending upwardly from the flange and a second portion extending downwardly from the flange. The second portion of each first projection is received in an opening (not shown) located in the rim sections 316, 318. The flange 336 and rim section 316 further include mating openings 348, 350 dimensioned to receive the single cleaned air outlet passage 110'''.

Figure 13:
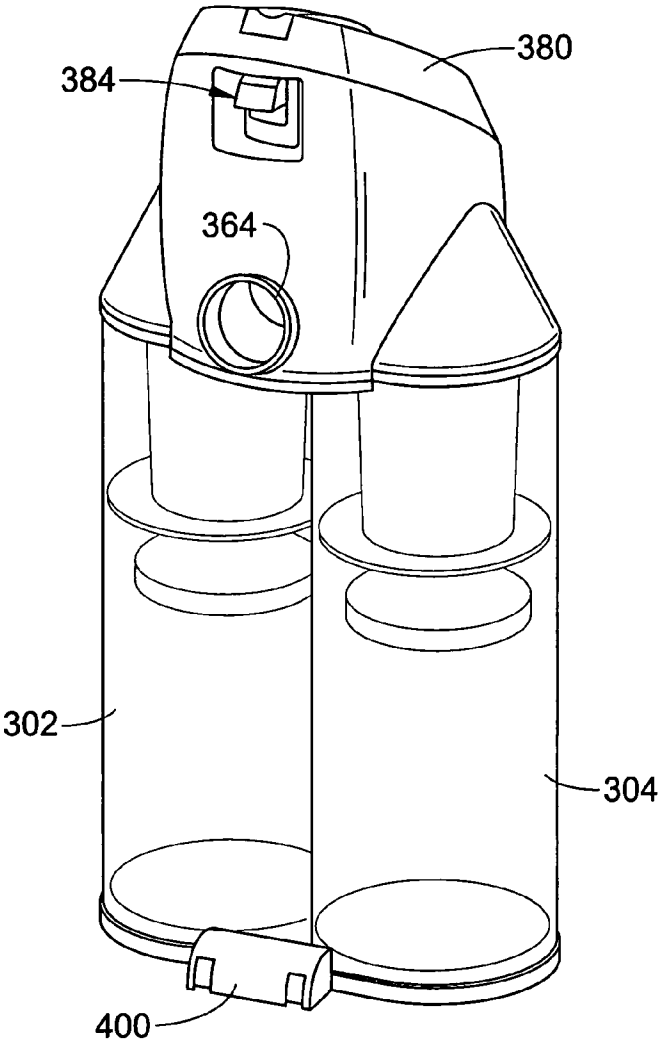
FIG. 13 is a rear perspective view of the dirt cup of FIG. 10.

With reference to FIG. 11, the air manifold 300 includes a top portion 356 and a bottom portion 358. The bottom portion includes a pair of cover plates 360 having a downwardly extending lip 362 which engages the top portion of the separator cones 334. As best shown in FIG. 13, an airstream inlet 364, which is in fluid communication with a nozzle main suction opening, extends outwardly from the bottom portion 358. Each cover plate includes an outlet 366 in fluid communication with an outlet 368 of the bottom portion 358 and a corresponding inlet 370 of the single cleaned air outlet passage 110'''. A vane 372 can direct the airstream from the outlets 366 to the inlet 370.

The bottom portion 358 further includes at least one tab 374. With reference now to FIG. 12, the tab includes an aperture (not shown) adapted to receive the upwardly extending first portion of at least one first projection 340. Similar to the flange 336, extending upwardly from the bottom portion are a plurality of second projections 376.

With continued reference to FIGS. 11 and 12, the top portion 356 includes a plurality of caps 378. The caps are adapted to receive the first and second projections 340, 374 thereby securing the top portion 356 of the air manifold to the bottom portion 358 of the air manifold and to the first and second generally cylindrical sections 302 and 304.

Figure 10:
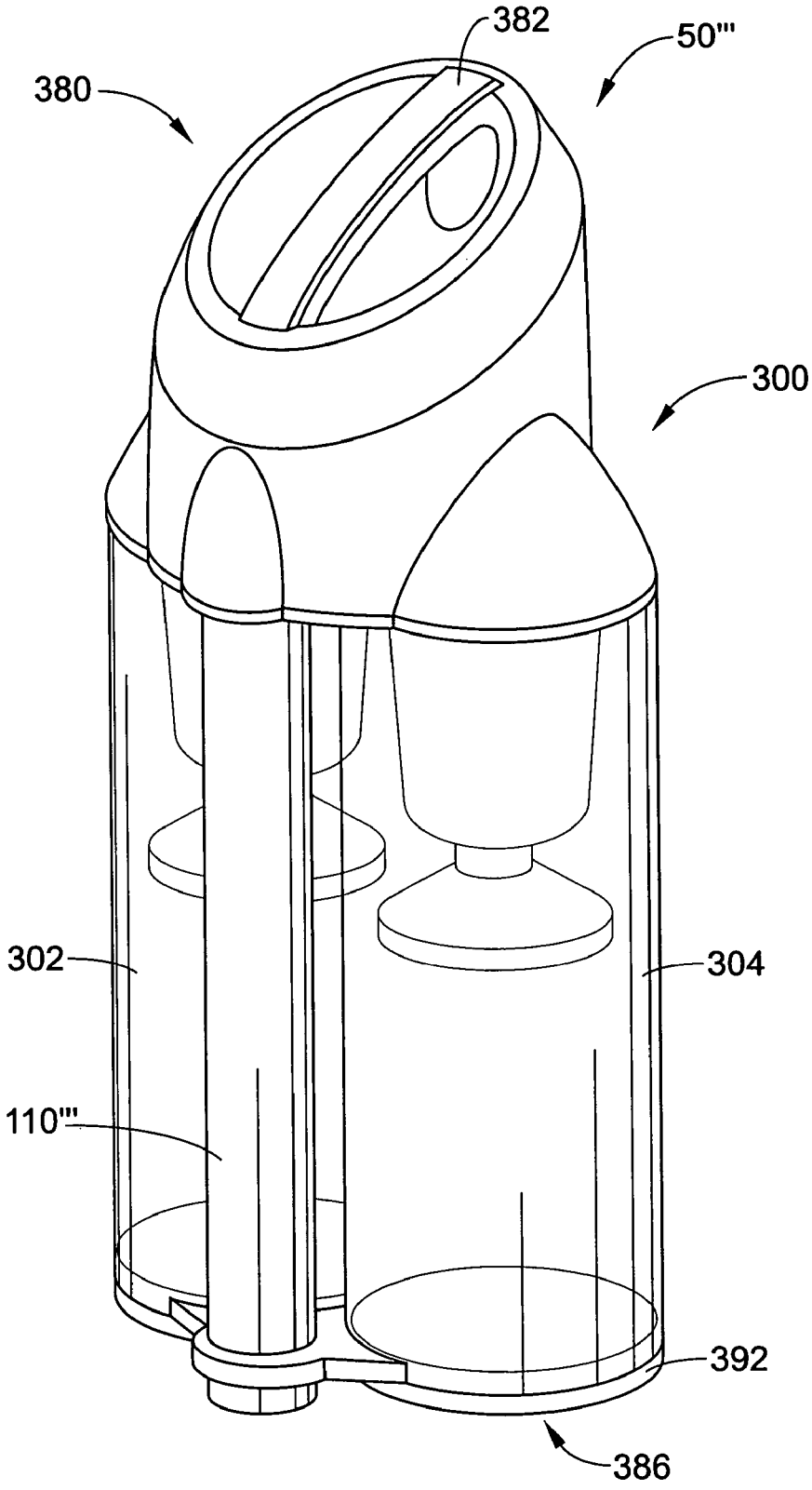
FIG. 10 is a front perspective view of a dirt cup for the cyclonic air flow vacuum cleaner of FIG. 1 in accordance with a fourth embodiment of the present invention.

With reference to FIG. 10, the dirt container 50''' includes a top wall 380 which is mounted to the air manifold 300. If desired, the top wall 380, including the air manifold 300 and the cyclone assemblies 330 and 332, could also be removable as a single unit from the top portion 320 of the cylindrical sections 302 and 304. Defined on the top wall is a handle 382 to facilitate operator movement of the dirt container. As shown in FIG. 13, a latch assembly 384, which is located on the top wall, cooperates with the upright housing section B to removably secure the dirt container 50''' to the upright housing section.

Figure 14:
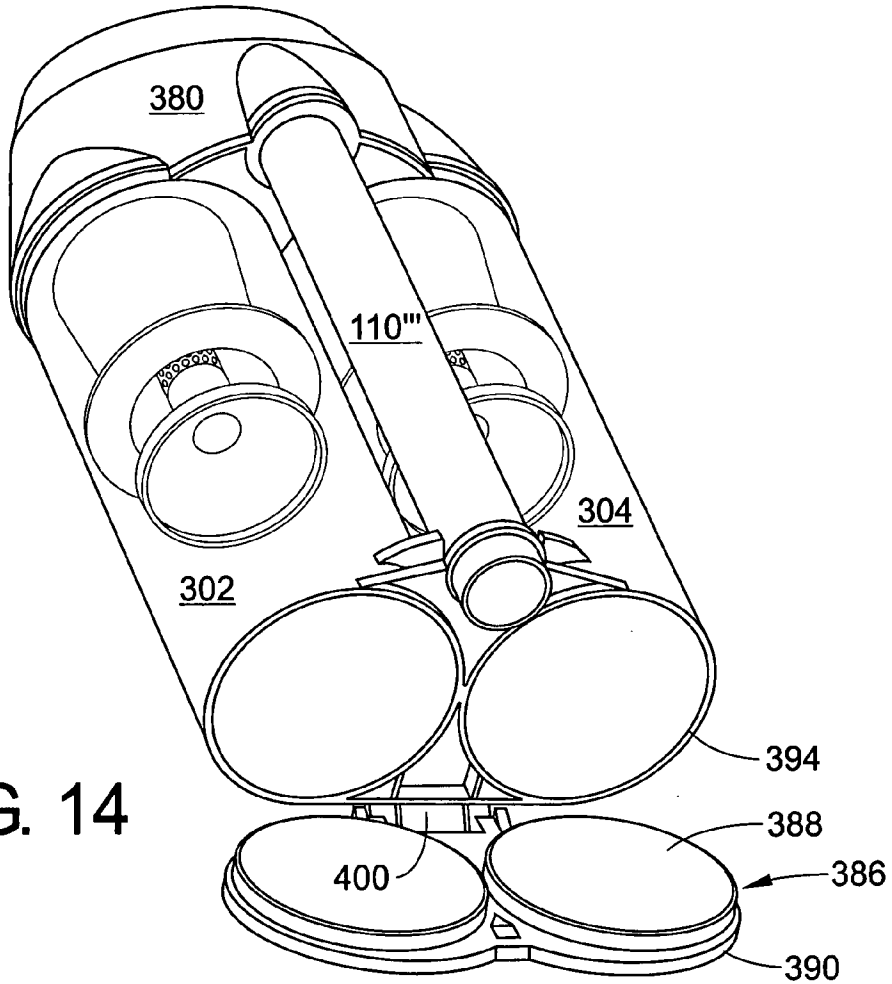
FIG. 14 is a front perspective view of the dirt cup of FIG. 10 with a bottom plate shown in an open position.

With reference to FIGS. 11 and 14, the dirt container 50''' further comprises a bottom plate or lid 386 including a pair of raised sections 388 and a continuous shelf 390. A pair of seal rings 392 can be fitted over the raised sections, a bottom portion of each seal ring sitting on the shelf 390. As shown in FIGS. 13 and 14, a hinge assembly 400 is used to mount the bottom plate to a bottom portion 394 of the first and second generally cylindrical sections 302 and 304. The hinge assembly allows the bottom plate 386 to be selectively opened so that dirt and dust particles that were separated from the airstream can be emptied from the dirt container.

The exemplary embodiments have been described with reference to several preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

What is claimed is:

1. A vacuum cleaner comprising:

a housing having a suction airstream inlet and a suction airstream outlet;

a dirt container selectively mounted to said housing for receiving and retaining dirt and dust separated from said suction airstream, and said suction airstream inlet and said suction airstream outlet being in fluid communication with, respectively, an inlet and an outlet of said dirt container, said dirt container including:

a first cyclonic airflow chamber including a longitudinal axis, a second cyclonic airflow chamber including a longitudinal axis, said second chamber being spaced from said first chamber, wherein said first and second chambers are each approximately vertically oriented and are arranged in a parallel relationship, and an air manifold disposed at a top portion of said dirt container, said air manifold including an inlet section through which dirty air passes, said inlet section receiving dirt entrained air directly from said suction airstream inlet and directing a flow of dirty air received directly from said suction airstream inlet into two separate inlet conduits leading to a respective one of said first and second airflow chambers for initial separation of dirt and dust from the airstream, and an outlet section, said outlet section collecting a flow of cleaned air from both of said chambers and merging the flow of cleaned air into a single outlet conduit; and, an airstream suction source mounted to said housing, said suction source being in communication with said outlet conduit of said manifold.

2. The vacuum cleaner of claim 1 wherein said vacuum cleaner further includes a cleaned air outlet passage, including a longitudinal axis which is oriented approximately parallel to said longitudinal axes of said first and second cyclonic chambers, at least a part of said cleaned air outlet passage forms part of an external surface of the vacuum cleaner.

3. The vacuum cleaner of claim 2 wherein said cleaned air outlet passage communicates with said manifold outlet conduit.

4. The vacuum cleaner of claim 2 wherein said cleaned air outlet passage is mounted to said dirt container.

5. The vacuum cleaner of claim 1 wherein each of said cyclonic chambers is cylindrical in shape, and each cyclonic chamber forms part of an external surface of the vacuum cleaner.

6. The vacuum cleaner of claim 1 further comprising:

a first perforated tube extending in said first cyclonic chamber; and, a second perforated tube extending in said second cyclonic chamber, wherein each of said first and second tubes includes a closed lower end and an open upper end in fluid communication with said inlet of said air manifold.

7. The vacuum cleaner of claim 6 wherein said closed lower end of each of said first and second tubes includes an outwardly flared portion.

8. The vacuum cleaner of claim 1 wherein each cyclonic chamber includes a separator cone having a larger diameter end located adjacent said top portion of said dirt container and a smaller diameter end spaced from said top portion, said separator cone at least partially dividing said cyclonic chamber into an upper portion for separating contaminants from the airstream and a lower portion for collecting the separated contaminants.

9. The vacuum cleaner of claim 1 further comprising a filter in fluid communication with said air manifold outlet conduit.

10. The vacuum cleaner of claim 9 wherein said filter is positioned in a plenum located in said housing, said plenum at least partially supporting a lower portion of said dirt container.

11. The vacuum cleaner of claim 1 wherein said air manifold is selectively detachable from said dirt container.

12. The vacuum cleaner of claim 1 wherein said air manifold is secured to said dirt container.

13. A vacuum cleaner including a housing, a nozzle base having a main suction opening, said housing being pivotally mounted on said nozzle base, an airstream suction source mounted to one of said housing and said nozzle base for selectively establishing and maintaining a suction airstream from said nozzle main suction opening to an exhaust outlet of said suction source, and a dirt cup selectively mounted to said housing, said dirt cup comprising:

a first centrifugal chamber having a first longitudinal axis, said first centrifugal chamber including a first cyclone assembly, wherein said first centrifugal chamber forms a first cylinder;

a second centrifugal chamber having a second longitudinal axis, oriented parallel to said first longitudinal axis, said second centrifugal chamber including a second cyclone assembly, wherein said second centrifugal chamber forms a second cylinder wherein said first and second cyclone assemblies act simultaneously to initially remove at least some contaminants from the airstream; and, an air manifold including:

a dirty air inlet in direct fluid communication with said main suction opening for receiving a contaminant entrained airstream from said main suction opening, a pair of dirty air outlets communicating with a respective one of said first and second centrifugal chambers, wherein the dirty air inlet directs the contaminant entrained airstream received from the main suction opening directly into the pair of dirty air outlets, a pair of cleaned air inlets communicating with a respective one of said first and second centrifugal chambers, and a cleaned air outlet in fluid communication with an inlet of said airstream suction source.

14. The vacuum cleaner of claim 13 wherein said dirt cup further includes a cleaned air outlet conduit, said cleaned air conduit being spaced from said housing, said cleaned air outlet conduit including a longitudinal axis oriented parallel to said longitudinal axes of said first and second centrifugal chambers, said cleaned air outlet conduit having an inlet end in fluid communication with said manifold cleaned air outlet and an outlet end in fluid communication with said airstream suction source.

15. The vacuum cleaner of claim 13 further including a filter disposed downstream from said first and second centrifugal chambers for filtering dirt from the airstream.

16. The vacuum cleaner of claim 15 further comprising a plenum mounted to one of said housing and said nozzle base for accommodating said filter.

17. The vacuum cleaner of claim 16 wherein said plenum is located beneath said dirt cup.

18. A dirt container for a vacuum cleaner comprising:

a dirt cup;

a first cyclonic flow chamber located in said dirt cup;

a second cyclonic flow chamber located in said dirt cup, said second chamber being positioned adjacent to and parallel to said first chamber, wherein said first and second chambers are oriented generally vertically;

a first perforated tube and a first separator cone extending in said first chamber, at least a portion of said first perforated tube being disposed within said first separator cone;

a second perforated tube and a second separator cone extending in said second chamber, at least a portion of said second perforated tube being disposed within said second separator cone, each tube including a plurality of small holes disposed in a side wall of said tube, each tube further including an outwardly flared end wall for retarding an upward flow of dust that has fallen below said end wall, and an air manifold disposed on an upper portion of said dirt cup, said air manifold having a dirty air inlet, wherein dirty air from a main suction opening of the vacuum cleaner flows into the dirt cup through the dirty air inlet, and wherein said air manifold directs dirty air to each of said first and second cyclonic flow chambers for initial separation of dirt and dust from the airstream, and wherein said air manifold directs a flow of cleaned air from each of said first and second cyclonic flow chambers to a suction source of the vacuum cleaner.

19. The vacuum cleaner of claim 18 further comprising a cleaned air outlet passage extending along said dirt cup.

20. The vacuum cleaner of claim 18 wherein said dirt cup comprises a bottom lid, with can be selectively opened to empty said dirt cup.

21. The vacuum cleaner of claim 20 wherein said bottom lid is configured to simultaneously empty dirt collected in said first and second cyclonic flow chambers.

22. The vacuum cleaner of claim 21 further comprising a latch and hinge assembly for selectively securing said bottom lid to said dirt cup.

* * * * *